US006485877B2

(12) United States Patent
Hakata

(10) Patent No.: US 6,485,877 B2
(45) Date of Patent: Nov. 26, 2002

(54) MAGNETIC PARTICLES AND MAGNETIC CARRIER FOR ELECTROPHOTOGRAPHIC DEVELOPER

(75) Inventor: Toshiyuki Hakata, Hiroshima (JP)

(73) Assignee: Toda Kogyo Corporation, Hiroshima-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/352,890

(22) Filed: Jul. 14, 1999

(65) Prior Publication Data

US 2001/0051311 A1 Dec. 13, 2001

(30) Foreign Application Priority Data

Jul. 17, 1998 (JP) ..... 10-203192

(51) Int. Cl.[7] ..... G03G 9/113

(52) U.S. Cl. ..... 430/111.35; 430/137.13; 428/405; 427/127

(58) Field of Search ..... 430/108, 106.6, 430/111.35, 111.32, 137.13; 428/405; 427/127, 215

(56) References Cited

U.S. PATENT DOCUMENTS 4,841,331 A 6/1989 Nakayama et al.
5,567,561 A * 10/1996 Yoshikawa et al. ..... 430/108
6,087,057 A * 7/2000 Hakata et al. ..... 430/111.35

FOREIGN PATENT DOCUMENTS

| | | | |
|---|---|---|---|
| EP | 0662644 | A2 | 7/1995 |
| EP | 0679956 | A1 | 11/1995 |
| JP | 60-76754 | | 5/1985 |
| JP | 62-66269 | | 3/1987 |
| JP | 3-242657 | | 10/1991 |
| JP | 5-107819 | | 4/1993 |
| JP | 06222619 | A | 8/1994 |
| JP | 07104522 | A | 4/1995 |
| JP | 10078681 | A | 3/1998 |

OTHER PUBLICATIONS

Grant, Roger et al. Grant and Hackh's Chemical Dictionary. New York: McGraw–Hill, Inc. p. 531, 1987.*

* cited by examiner

*Primary Examiner*—Christopher Rodee
(74) *Attorney, Agent, or Firm*—Nixon & Vanderhye P.C.

(57) ABSTRACT

Magnetic particles having an average particle size of 10 to 200 $\mu$m, comprising:

magnetic core particles; and a coating layer formed on each surface of said magnetic core particles, comprising at least one metal alkoxide represented by the general formula (I):

$$(RO)_nM \quad (I)$$

wherein R is a $C_1$ to $C_{16}$ alkyl group; M is Al, Ti, Na, K, Ca, Zn or Fe; and n is an integer of 1 to 4, at least one silane-based coupling agent, and a silicone resin.

Such magnetic particles have an excellent durability and a stable charging property.

18 Claims, No Drawings

MAGNETIC PARTICLES AND MAGNETIC CARRIER FOR ELECTROPHOTOGRAPHIC DEVELOPER

BACKGROUND OF THE INVENTION:

The present invention relates to magnetic particles and a magnetic carrier for an electrophotographic developer comprising the magnetic particles, and more particularly, to magnetic particles for use as an electrophotographic magnetic carrier in an electrophotographic developer, which have an excellent durability and a stable charging property, an electrophotographic magnetic carrier for an electrophotographic developer, and an electrophotographic developer using the electrophotographic magnetic carrier.

In electrophotographic developing methods, a photosensitive member composed of a photoconductive material such as selenium, OPC (organic semiconductor), a-Si or the like has been used to form an electrostatic latent image thereon by various means. Then, by using a magnetic brush method or the like, a toner having a polarity reverse to that of the latent image is attached thereon to form the latent image by the electrostatic force.

As is well known in the art, in the above developing methods, there have been used support particles called a magnetic carrier. The magnetic carrier acts for imparting an appropriate positive or negative electrical quantity to the toner by frictional electrification, and transferring the toner into a developing zone near the surface of the photosensitive member by a developing sleeve in which magnets are accommodated, using the magnetic force thereof.

In recent years, the electrophotographic developing method has been widely applied to copying machines or printers. In these apparatuses, it has been demanded to meet various requirements including not only reproduction of thin lines, small characters, photographs, color originals or the like, but also a high image quality, a high image grade, a high copying or printing speed, a continuous image formation or the like. The requirements for these properties have been estimated to become increased more and more in future.

In order to satisfy not only the applicability to various objectives but also the high image quality and the high image grade, the reduction in a particle size of the toner particles and the magnetic carrier particles, has been studied. In particular, it has been strongly demanded to provide magnetic carrier particles having an average particle size as small as 10 to 50 $\mu$m.

On the other hand, in order to satisfy the high copying or printing speed and the continuous image formation, it has been strongly demanded to enhance the durability of these particles as developer. In the case of the magnetic carrier, there has been proposed such a method which comprises iron particles obtained by a mechanical pulverization method, an electrolytic method, a reduction method, a heat-decomposition method, a sintering method or the like; granulating and then heat-sintering various ferrite fine particles or magnetite fine particles to form granulated sintered particles; dispersing magnetic particles or magnetic particle and non-magnetic particles in a binder resin to form composite particles (hereinafter referred to merely as "magnetic core particles"); and then coating the surfaces of the obtained magnetic core particles with various resins. The above magnetic carrier has been already put into practice.

There is no end of a demand for the enhancement in properties of the electrophotographic developers. In order to continuously obtain a clear image, it is desired that the charge amount of the magnetic carrier is kept unchanged and stable even after the magnetic carrier is used for a long period of time. Specifically, when the magnetic carrier is used for a long period of time, there arises such a problem that the coating resin layer is peeled off from the surfaces of the magnetic core particles, so that the charging property of the magnetic carrier is deteriorated, whereby the magnetic carrier cannot impart an appropriate charge to the toner. Therefore, it has been demanded that the coating resin layer can be prevented from being peeled off from the surfaces of the magnetic core particles in order to enhance the durability of the magnetic carrier, thereby allowing the magnetic carrier to show a more stable charging property.

Hitherto, in order to enhance the durability of the magnetic carrier, there have been proposed a magnetic carrier obtained by coating the surfaces of magnetic core particles with a silicone resin (Japanese Patent Publication (KOKOKU) No. 2-3181(1990), Japanese Patent Application Laid-Open (KOKAI) Nos. 62-66269(1987) and 3-242657 (1991), etc.); a magnetic carrier obtained by coating the surfaces of magnetic core particles with a silicone resin containing a silane-based coupling agent (Japanese Patent Application Laid-Open (KOKAI) No. 5-107819(1993), etc.); or the like.

At the present time, it has been strongly required to provide an electrophotographic magnetic carrier having an excellent durability and a stable charging property. However, such a magnetic carrier has not been obtained yet.

That is, in the production of the above-mentioned conventional magnetic carriers, when the coating resin layer is formed on the surfaces of the magnetic core particles, fatty acid metal salts, especially organic tin compounds, have been used together with the silicone resin in order to cure the resin. The more the amount of the organic tin compound used is increased, the more the resin can be cured more readily. As a result, it becomes possible to form a uniform and satisfactory coating resin layer without causing the aggregation between the magnetic carrier particles. However, when the amount of the organic tin compound used is as large as not less than 0.4% by weight based on the weight of the resin solid content, the obtained coating resin layer becomes brittle, so that upon a long-term use of the magnetic carrier, the coating resin layer tends to be peeled off from the surfaces of the magnetic core particles, resulting in change in charge amount, i.e., unstable charge amount of the magnetic carrier.

On the other hand, when the amount of the organic tin compound used is reduced, it is difficult to cure the coating resin and, therefore, to form a uniform and satisfactory coating resin layer on the surfaces of the magnetic core particles. In addition, there arises such a problem that upon forming the coating resin layer or upon subsequent heat-treatments, the magnetic carrier particles are aggregated together, thereby deteriorating the yield. This phenomenon becomes more remarkable in the case where it is intended to sufficiently and uniformly coat the magnetic core particles having a small particle size especially not more than 50 $\mu$m, with a silicone resin.

As a result of the present inventor's earnest studies, it has been found that by coating each surface of the magnetic core particles with a silicone resin composition comprising at least one metal alkoxide, at least one silane-based coupling agent and a silicone resin, the obtained magnetic particles are useful as an electrophotographic magnetic carrier for an electrophotographic developer. The present invention has been attained on the basis of the finding.

SUMMARY OF THE INVENTION

It is an object of the present invention to produce magnetic particles having an excellent durability and a stable charging property with a high yield without using any organic tin compound.

It is another object of the present invention to provide an electrophotographic magnetic carrier for an electrophotographic developer which has an excellent durability and, therefore, a stable charging property.

It is a further object of the present invention to provide an electrophotographic developer having an excellent durability.

To accomplish the aims, in a first aspect of the present invention, there are provided magnetic particles having an average particle size of 10 to 200 μm. which comprise magnetic core particles, and a coating layer formed on each of said magnetic core particles, comprising at least one metal alkoxide represented by the general formula (I):

$$(RO)_nM \quad (I)$$

wherein R is a $C_1$ to $C_{16}$ alkyl group; M is Al, Ti, Na, K, Ca, Zn or Fe; and n is an integer of 1 to 4, at least one silane-based coupling agent and a silicone resin.

In a second aspect of the present invention, there is provided a magnetic carrier for an electrophotographic developer which comprises magnetic particles having an average particle size of 10 to 200 μm, which comprise magnetic core particles, and a coating layer formed on each of said magnetic core particles, comprising at least one metal alkoxide represented by the general formula (I):

$$(RO)_nM \quad (I)$$

wherein R is a $C_1$ to $C_{16}$ alkyl group; M is Al, Ti, Na, K, Ca, Zn or Fe; and n is an integer of 1 to 4, at least one silane-based coupling agent and a silicone resin.

In a third aspect of the present invention, there is provided a developer comprising a toner and a magnetic carrier which comprises magnetic particles having an average particle size of 10 to 200 μm, which comprise magnetic core particles, and a coating layer formed on each of said magnetic core particles, comprising at least one metal alkoxide represented by the general formula (I):

$$(RO)_nM \quad (I)$$

wherein R is a $C_1$ to $C_{16}$ alkyl group; M is Al, Ti, Na, K, Ca, Zn or Fe; and n is an integer of 1 to 4, at least one silane-based coupling agent and a silicone resin.

DETAILED DESCRIPTION OF THE INVENTION

Various conditions for carrying out the present invention are described below.

First the magnetic particles according to the present invention are described.

The magnetic particles according to the present invention have an average particle size of usually 10 to 200 μm. When the average particle size is less than 10 μm, there is caused such a phenomenon that a toner is firmly adhered onto the surfaces of the magnetic particles, so that the charging property inherent to the magnetic particles is lost, i.e., a so-called spent toner. On the other hand, when the average particle size is more than 200 μm, it is difficult to obtain a clear image. In particular, in order to obtain images having a more high quality and a more high grade, the average particle size of the magnetic particles are preferably 10 to 100 μm, more preferably 10 to 50 μm.

As the magnetic core particles used in the present invention, there may be used any kind of the magnetic core particles described hereinbefore.

As the granulated sintered particles, there may be used magnetic particles such as ferrite particles containing at least one element selected from the group consisting of lithium, manganese, magnesium or the like or magnetite particles. Specific examples of the preferred fine particles may include lithium-manganese ferrite, lithium-manganese ferrite, magnesium ferrite and copper-zinc ferrite.

As the composite particles, there may be used those particles obtained by granulating a mixture composed of a resin, magnetic fine particles such as the above-mentioned ferrite fine particles or magnetite fine particles and, if required, non-magnetic fine particles such as hematite fine particles, by a kneading and pulverizing method or a polymerization method. In order to obtain a magnetic carrier having a further enhanced durability, the use of composite particles having a specific gravity as low as especially 2 to 4, is preferred. Also, in order to obtain such a magnetic carrier having a high magnetization value, the use of the granulated sintered particles is preferred.

Incidentally, the magnetic fine particles or non-magnetic fine particles used upon the production of the composite particles as the magnetic core particles, may have any particle shape including a spherical shape, a plate-like shape, an acicular shape or the like. The average particle size of the magnetic fine particles or the non-magnetic particles is preferably 0.05 to 5.0 μm. Further, in order to improve the properties of these particles such as dispersibility in resins, the magnetic fine particles or non-magnetic fine particles may be surface-treated with a coupling agent or the like to impart a hydrophilic property thereto.

The magnetic core particles may also have any particle shape such as a spherical shape, a granular shape, a plate-like shape or the like.

The average particle size of the magnetic core particles is usually 8 to 195 μm, preferably 10 to 100 μm. When the average particle size of the magnetic core particles is less than 8 μm, the particle size of the obtained magnetic particles becomes less than 10 μm. On the other hand, when the average particle size of the magnetic core particles is more than 195 μm the particle size of the obtained magnetic particles becomes more than 200 μm.

The coating resin composition used for the magnetic particles according to the present invention, comprises a silicone resin, a metal alkoxide and a silane-based coupling agent. As to the silicone resins, in the consideration of the durability of the obtained magnetic particles, the ratio of trifunctional silicone (hereinafter referred to merely as "T") to bifunctional silicone (hereinafter referred to merely as "D") is preferably in the range of 95:5 to 40:60, more preferably 95:5 to 50:50.

The amount of the coating resin composition is usually 0.05 to 10% by weight based on the weight of the magnetic core particles. When the amount of the coating resin composition is less than 0.05% by weight, the obtained coating resin layer tends to become insufficient and non-uniform, so that it may be difficult to enhance the durability of the magnetic particles. On the other hand, when the amount of the coating resin composition applied is too large, the obtained coating resin layer tends to be peeled off from the surfaces of the magnetic core particles, so that it may be difficult to produce a magnetic carrier having a stable charging property. The amount of the coating resin composition is preferably 0.1 to 10% by weight, more preferably 0.2 to 5% by weight based on the weight of the magnetic core particles.

The metal alkoxide of the coating resin composition used in the present invention, is represented by the general formula:

$$(RO)_nM$$

wherein R is a $C_1$ to $C_{16}$ alkyl group; M is Al, Ti, Na, K, Ca, Zn or Fe; and n is an integer of 1 to 4.

In the consideration of industrial or economical uses, the R is preferably a $C_2$ to $C_8$ alkyl group, more preferably a $C_2$ to $C_4$ alkyl group. In order to further enhance the durability of the coating resin layer, the M is preferably Al or Ti. Specific examples of the metal alkoxides usable in the present invention, may include aluminum-tri-n-butoxide (n=4, M=Al), aluminum-tri-ethoxide (n=2, M=Al), aluminum-tri-sec-butoxide (n=4, M-Al), aluminum-tri-isopropoxide (n=3, M=Al), titanium-tetra-n-butoxide (n=4, M=Ti), titanium-tetraethoxide (n=2, M=Ti), titanium-tetra-iso-propoxide (n=3, M=Ti) or the like.

The amount of the metal alkoxide used is preferably 0.05 to 0.4% by weight, more preferably 0.05 to 0.35% by weight based on the solid content of the silicone resin. When the amount of the metal alkoxide used is less than 0.05% by weight, the curing speed of the silicone resin may be low, so that the magnetic carrier particles tend to be agglomerated together, resulting in low yield. On the other hand, when the amount of the metal alkoxide used is more than 0.3% by weight, the obtained coating resin layer may become brittle, resulting in deteriorated durability thereof.

As the silane-based coupling agents used in the coating resin composition of the present invention, there may be exemplified coupling agents containing an amino group, an epoxy group, a vinyl group, a mercapto group, a halogen atom and/or an alkyl group therein. Specific examples of the silane-based coupling agents may include amino-containing silane-based coupling agents such as γ-aminopropyl trimethoxysilane, N-β-aminoethyl-γ-aminopropyl trimethoxysilane, N-β-aminoethyl-γ-aminopropylmethyl dimethoxysilane, N-phenyl-γ-aminopropyl trimethoxysilane or the like; epoxy-containing silane-based coupling agents such as γ-glycidoxypropylmethyl diethoxysilane, β-3,4-epoxycyclohexyl trimethoxysilane, γ-glycidoxypropyl trimethoxysilane or the like; vinyl-containing silane-based coupling agents such as vinyl trichlorosilane, vinyl triethoxysilane, vinyl-tris(β-methoxy) silane or the like; halogen-containing silane-based coupling agents such as dimethyl dichlorosilane, methyl trichlorosilane, allyl dimethyl chlorosilane, allyl phenyl dichlorosilane, benzyl dimethyl chlorosilane, bromomethyl dimethyl chlorosilane, α-chloroethyl trichlorosilane, β-chloroethyl trichlorosilane or the like; mercapto-containing silane-based coupling agents such as γ-mercaptopropyl trimethoxysilane; or alkyl-containing silane-based coupling agents such as trimethyl silane or the like. In the case where the charge amount of a negative toner is required to increase, the use of the amino-containing silane-based coupling agents is preferable. Also, in the case where the charge amount of the toner is to be kept unchanged, the use of the epoxy-containing silane-based coupling agents is preferable.

The amount of the silane-based coupling agent used is preferably 0.1 to 20.0% by weight, more preferably 1 to 15% by weight based on the solid content of the silicone resin. When the amount of the silane-based coupling agent used is less than 0.1% by weight, the curing speed of the silicone resin may be low, so that it may be difficult to form the aimed coating resin layer having an excellent durability, and the obtained magnetic particles tend to agglomerate together. On the other hand, when the amount of the silane-based coupling agent used is more than 20.0% by weight, the obtained coating resin layer may become brittle, resulting in deteriorated durability, so that the obtained magnetic carrier tends to show an unstable charging property.

In the coating silicone resin composition used in the present invention, at least two of the metal alkoxide, the silane-based coupling agent and the silicone resin may be interacted to each other.

Next, the process for producing the magnetic particles, is explained.

As described above, the magnetic particles according to the present invention, can be obtained by diluting the silicone resin composition composed of the silicone resin, the metal alkoxide and the silane-based coupling agent with an organic solvent such as toluene or the like so as to adjust the solid content thereof to 5 to 30% by weight; and then adding to the magnetic core particles a coating solution which is prepared by adjusting the amounts of the above respective components added such that the gelation time of the silicone resin composition becomes in the range of 2 to 5 hours, thereby coating each surface of the magnetic core particles with the coating solution. Almost a whole amount of the thus applied coating solution is deposited over the surfaces of the magnetic core particles, thereby forming a coating resin layer on the magnetic core particles.

When the solid content of the coating solution is less than 5% by weight, the removal of the solvent such as toluene, etc., may need a long period of time, resulting in industrially and economically disadvantageous process. On the other hand, when the solid content of the coating solution is more than 30% by weight, it may be difficult to form a sufficient and uniform coating resin layer composed of the silicone resin composition on the surfaces of the magnetic core particles. When the gelation time is less than 2 hours, the viscosity of the coating solution itself may be increased, so that it may be also difficult to form a sufficient and uniform coating resin layer composed of the silicone resin composition on the surfaces of the magnetic core particles. On the other hand, when the gelation time exceeds 5 hours, the magnetic core particles tend to be agglomerated together.

The amount of the coating solution added is preferably 0.05 to 10.0% by weight (calculated as solid content) based on the weight of the magnetic core particles. When the amount of the coating solution added is less than 0.05% by weight, there is a tendency that the magnetic core particles are insufficiently and non-uniformly coated with the silicone resin composition. On the other hand, when the amount of the coating solution added is more than 10.0% by weight, the obtained magnetic carrier may show a too high electrical resistance, thereby causing deteriorated images such as charge-up or the like.

The magnetic particles according to the present invention have (1) a true specific gravity of usually 2 to 7, preferably 2.5 to 4.5; (2) a volume resistivity of usually not less than $10^6$ Ω·cm, preferably $10^7$ to $10^{15}$ Ω·cm; (3) a saturation magnetization value of usually 10 to 90 emu/g, preferably 20 to 90 emu/g; and (4) a durability (change in charge amount) of usually not more than 15%, preferably not more than 10%.

The important point of the present invention is such a fact that the magnetic particles obtained by coating each surface of the magnetic core particles with the silicone resin composition comprising the silicone resin, the metal alkoxide and the silane-based coupling agent, can show an excellent durability and a stable charging property.

The reason why the magnetic particles according to the present invention can show an excellent durability, is considered as follow. That is, the coating resin layer and the magnetic core particles are firmly adhered to each other, and the coating resin layer is effectively prevented from being deteriorated because any organic thin compound is not used therein, so that the peeling-off of the coating resin layer can be inhibited even after being used for a long period of time.

The reason why the magnetic particles can be produced with a high yield even though the magnetic core particles used have a small particle size, is considered as follows. That is, since the magnetic core particles are sufficiently and uniformly coated with the silicone resin composition so as to eliminate an exposed surface portion thereof, the obtained magnetic particles can be prevented from being agglomerated together.

Thus, the magnetic particles according to the present invention can exhibit an excellent durability and is free from the peeling-off of the coating resin layer even after being used for a long period of time. In addition, the magnetic particles show a stable charging property and, therefore, are suitable as an electrophotographic magnetic carrier for electrophotographic developer.

Further, since the magnetic particles are prevented from being agglomerated together upon forming the coating resin layer or upon subsequent heat-treatments especially even though the magnetic core particles used have a small particle size, the magnetic particles according to the present invention can be produced with a high yield and is, therefore, industrially and economically advantageous.

The electrophotographic magnetic carrier for electrophotographic developer according to the present invention shows an excellent durability and a stable charging property.

The electrophotographic developer according to the present invention shows an excellent durability and achieves a high copying and printing speed and continuous image formation in the electrophotographic developing method.

EXAMPLES

The present invention is described in more detail by Examples and Comparative Examples, but the Examples are only illustrative and, therefore, not intended to limit the scope of the present invention.

Various properties were evaluated by the following methods.

The average particle size of particles in the following Examples and Comparative Examples is expressed by the value measured by a laser diffraction-type granulometer (manufactured by Horiba Seisakusho Co., Ltd.). Further, the particle shape of the particles was observed by a scanning electron microscope (S-800, manufactured by Hitachi Ltd.).

The saturation magnetization is expressed by the value measured by "Vibration Sample-type Magnetometer VSM-3S-15 (manufactured by Toei Kogyo Co., Ltd.) when applying an external magnetic field of 10 kOe.

The true specific gravity is expressed by the value measured by a multi-volume densitometer (manufactured by Micromeritex Co., Ltd.).

The volume resistivity is expressed by the value measured by a high-resistance meter (4329A, manufactured by Yokogawa-Hewlett Packard Co., Ltd.).

The durability test was conducted as follows.

50 g of magnetic carrier particles were charged into a 100 cc glass sampling bottle, and the bottle was then capped. Thereafter, the sampling bottle was shaken for 10 minutes by a paint conditioner (manufactured by Red Devil Co., Ltd.). The charge amounts of each sample before and after the shaking were measured.

The charge amount was measured as follows.

95 parts by weight of magnetic carrier particles and 5 parts by weight of the toner produced in Example 2 were intimately mixed with each other, and then the charge amount of the magnetic carrier particles was measured by a blow-off charge-measuring apparatus (manufactured by Toshiba Chemical Co., Ltd.).

The yield of magnetic particles composed of magnetic core particles and a coating resin layer formed on each surface thereof, is expressed by the percentage obtained by dividing the amount of the magnetic particles passed through sieves having sieve openings of 44 $\mu$m (in case of magnetic core particles A), 63 $\mu$m (in case of magnetic core particles B), 63 $\mu$m (in case of magnetic core particles C), 75 $\mu$m (in case of magnetic core particles D) and 75 $\mu$m (in case of magnetic core particles E), respectively, by the amount of the magnetic particles before passing through the sieves.

Example 1

<Production of Magnetic Core Particles>

One kilogram of spherical magnetite particles were charged into a Henschel mixer. While intimately stirring the magnetite particles, 7.5 g of a silane-based coupling agent (KBM-602, produced by Shin-Etsu Chemical Co., Ltd.) was added thereto, and then both components were intimately mixed together, thereby coating the surfaces of the spherical magnetite particles with the silane-based coupling agent.

Separately, 50 g of phenol, 75 g of 37% formalin, 400 g of the above spherical magnetite particles subjected to a lipophilic treatment, 15 g of 25% ammonia water and 50 g of water were charged into an one-liter four-neck flask, and heated to 85° C. for 60 minutes while stirring. At that temperature, the resultant mixture was reacted and cured, thereby producing composite particles composed of the phenol resin and the spherical magnetite particles.

Next, the contents of the flask were cooled to 30° C. and then 0.5 liter of water added thereto. Thereafter, a supernatant liquid was removed therefrom, and a remaining precipitate was washed with water and air-dried.

The obtained product was further dried at a temperature of 150 to 180° C. under reduced pressure (not more than 5 mmHg), thereby obtaining composite particles (hereinafter referred to as "composite particles A"). The yield of the obtained composite particles A was 95%.

The thus obtained composite particles A were spherical particles (sphericity: 1.1:1) containing magnetite particles in an amount of 88% by weight. It was confirmed that the obtained composite particles had an average particle size of 18 $\mu$m, a specific gravity of 3.55, a saturation magnetization value of 75 emu/g and a volume resistivity of $1\times10^8$ $\Omega\cdot$cm.

<Production of Magnetic Particles>

One kilogram of the composite particles A as magnetic core particles were placed in a universal stirrer (5XDML, manufactured by Dalton Co., Ltd.), and stirred until the temperature of the particles reached 50° C. Separately, 30 g (as solid content) of a silicone resin (ratio of T/D units: 90/10), 0.03 g of aluminum-tri-sec-butoxide (n=4, M=Al) as a metal alkoxide (hereinafter referred to as "alkoxide F") and 0.9 g of $\gamma$-aminopropyl trimethoxysilane KBM903 (tradename: produced by Shin-Etsu Chemical Co., Ltd.) as a coupling agent (hereinafter referred to as "silane coupling agent a") were diluted with toluene so as to adjust the solid content of the silicone resin therein to 20% by weight, thereby preparing a coating solution. The thus obtained coating solution was mixed with the magnetic core particles. Successively, the resultant mixture was stirred at 50° C. for one hour, and then heat-treated at 200° C. for 2 hours in a nitrogen atmosphere.

As a result of the observation by an electron microscope, it was confirmed that the magnetic core particles were satisfactorily and uniformly coated with the silicone resin, and the amount of the silicone resin adhered was 2.5% by weight based on the weight of the magnetic core particles. The obtained composite particles coated with the silicone resin composition containing the metal alkoxide and the silane coupling agent, had an average particle size of 19 $\mu$m, a true specific gravity of 3.53, an electrical resistance value of $6\times10^{13}$ Ω·cm, a saturation magnetization value of 74 emu/g and a percentage of change in charge amount of 6% (initial charge: −45 $\mu$C/g; charge after shaking: −42 $\mu$C/g).

Example 2

| <Production of toner> | |
|---|---|
| Polyester resin obtained by the condensation of propoxylated bisphenol and fumaric acid | 100 parts by weight |
| Phthalocyanine pigment | 4 parts by weight |
| Di-tert-butyl salicylate chromium complex | 4 parts by weight |

The above components were sufficiently premixed with each other by a Henschel mixer, and melt-kneaded by a twin-screw extrusion-type kneader. After cooling, the obtained mixture was crushed into coarse particles by a hammer mill, and then finely pulverized by an air jet-type pulverizer. The obtained fine particles were subjected to classification, thereby obtaining a negative cyan-colored particles. 100 parts by weight of the obtained color particles were mixed with 10 parts by weight of titanium oxide fine particles by a Henschel mixer, thereby obtaining a cyan toner.

<Production of Electrophotographic Developer>

95 parts by weight of a magnetic carrier composed of the magnetic particles obtained in Example 1 was mixed with 5 parts by weight of the above-obtained toner, thereby producing an electrophotographic developer.

Examples 3 to 8 and Comparative Examples 1 to 4

First, magnetic core particles A to E were prepared.

The production conditions of composite particles B and C as magnetic core particles are shown in Table 1, and the properties of the magnetic core particles B to E are shown in Table 2.

Table 1

| Production of composite particles | | | | | |
|---|---|---|---|---|---|
| | Magnetic fine particles | | | | |
| | | | Agent for lipophilic treatment | | |
| Kind of magnetic core particles | Particle Kind | Particle size (rb) ($\mu$m) | Kind | Amount treated (wt %) | Amount (g) |
| B | Granular hematite | 0.40 | KBM-403 | 0.75 | 240 |
| C | — | — | — | — | — |

Table 1-continued

| Production of composite particles | | | | | |
|---|---|---|---|---|---|
| core particles | Kind | size ($\mu$m) | Kind | treated (wt %) | Amount (g) |
| B | Spherical magnetite | 0.31 | KBM-602 | 0.75 | 160 |
| C | Spherical magnetite | 0.24 | KBM-403 | 0.5 | 400 |

| Non-magnetic particles | | | | | |
|---|---|---|---|---|---|
| | | | Agent for lipophilic treatment | | |
| Kind of magnetic core particles | Kind | Particle size (rb) ($\mu$m) | Kind | Amount treated (wt %) | Amount (g) |
| B | Granular hematite | 0.40 | KBM-403 | 0.75 | 240 |
| C | — | — | — | — | — |

| Kind of magnetic core particles | Phenols Amount (g) | 37% Formalin Amount (g) | Suspension stabilizer Kind | Suspension stabilizer Amount (g) |
|---|---|---|---|---|
| B | 45 | 67 | — | — |
| C | 45 | 67 | Calcium fluoride | 1.0 |

| Kind of magnetic core particles | Basic catalyst Kind | Basic catalyst Amount (g) | Water Amount (g) |
|---|---|---|---|
| B | Ammonia water | 14 | 50 |
| C | Ammonia water | 14 | 45 |

TABLE 2

| Kind of magnetic core particles | | Average particle size ($\mu$m) | Shape | Sphericity (major diameter/minor diameter |
|---|---|---|---|---|
| B | Composite particles | 35 | Spherical | 1.2:1 |
| C | Composite particles | 40 | Spherical | 1.1:1 |
| D | Ferrite granulated sintered particles ($CuO$: 15 mol %; $ZnO$: 15 mol %; $Fe_2O_3$: 70 mol %) | 50 | Spherical | 1.3:1 |
| E | Ferrite granulated sintered particles ($Li_2CO_3$: 10 mol %; $MnCO_3$: 15 mol %; $Fe_2O_3$: 75 mol %) | 45 | Spherical | 1.3:1 |

| Kind of magnetic core particles | Specific gravity | Content of magnetic particles (wt %) | Content of non-magnetic particles (wt %) |
|---|---|---|---|
| B | 3.58 | 35.1 | 52.5 |
| C | 3.56 | 88.1 | 0 |
| D | 5.12 | 100 | 0 |
| E | 5.10 | 100 | 0 |

| Kind of magnetic | Saturation |
|---|---|

TABLE 2-continued

| core particles | magnetization value (emu/g) | Volume resistivity value (Ω · cm) |
|---|---|---|
| B | 31 | $4 \times 10^{12}$ |
| C | 76 | $2 \times 10^{7}$ |
| D | 68 | $2 \times 10^{8}$ |
| E | 63 | $5 \times 10^{9}$ |

Next, the same procedure as defined in Example 1 was conducted except that kind of the magnetic core particles, kind and amount of the silicone resin, use or non-use, kind and amount of the metal alkoxide, use or non-use, kind and amount of the coupling agent, and addition or non-addition and amount of the organic tine compound, were varied, thereby producing magnetic particles composed of the magnetic core particles coated with the silicone resin.

Main production conditions are shown in Table 3, and various properties of the obtained particles are shown in Table 4.

TABLE 3

| Examples and Comparative Examples | Magnetic core particles | | Coating with silicone resin Silicone resin | | |
|---|---|---|---|---|---|
| | Kind | Amount (g) | Ratio of T/D units | Solid content (g) | Silicone resin/ magnetic core particles (wt %) |
| Example 3 | A | 1000 | 95/5 | 30 | 3.0 |
| Example 4 | B | 1000 | 100/0 | 25 | 2.5 |
| Example 5 | C | 1000 | 80/20 | 20 | 2.0 |
| Example 6 | C | 1000 | 60/40 | 15 | 1.5 |
| Example 7 | D | 1000 | 90/10 | 30 | 3.0 |
| Example 8 | E | 1000 | 95/5 | 20 | 2.0 |
| Comparative Example 1 | A | 1000 | 80/20 | 30 | 3.0 |
| Comparative Example 2 | A | 1000 | 90/10 | 25 | 2.5 |
| Comparative Example 3 | A | 1000 | 90/10 | 25 | 2.5 |
| Comparative Example 4 | A | 1000 | 90/10 | 30 | 3.0 |

| Examples and Comparative Examples | Coating with silicone resin | | | |
|---|---|---|---|---|
| | Metal alkoxide | | Coupling agent | |
| | Kind | Amount (g) | Kind | Amount (g) |
| Example 3 | G | 0.05 | b | 3.0 |
| Example 4 | H | 0.02 | b | 0.5 |
| Example 5 | F | 0.07 | c | 0.6 |
| Example 6 | G | 0.05 | c | 0.3 |
| Example 7 | G | 0.05 | d | 0.3 |
| Example 8 | F | 0.03 | b | 1.5 |
| Comparative Example 1 | — | — | b | 0.3 |
| Comparative Example 2 | — | — | a | 0.2 |
| Comparative Example 3 | — | — | a | 0.2 |
| Comparative Example 4 | F | 0.06 | — | — |

| Examples and Comparative Examples | Coating with silicone resin Organic tin compound | | |
|---|---|---|---|
| | Kind | Amount (g) | Yield |
| Example 3 | — | — | 93 |
| Example 4 | — | — | 98 |
| Example 5 | — | — | 98 |
| Example 6 | — | — | 95 |
| Example 7 | — | — | 99 |
| Example 8 | — | — | 98 |
| Comparative Example 1 | — | — | 75 |
| Comparative Example 2 | e | 0.15 | 93 |
| Comparative Example 3 | e | 0.05 | 88 |
| Comparative Example 4 | — | — | 87 |

TABLE 4

| Examples and Comparative Examples | Resin-coated magnetic core particles | | |
|---|---|---|---|
| | Average particle size (μm) | Bulk density (g/ml) | Specific gravity |
| Example 3 | 19 | 1.73 | 3.53 |
| Example 4 | 35 | 1.80 | 3.56 |
| Example 5 | 40 | 1.89 | 3.56 |
| Example 6 | 40 | 1.90 | 3.57 |
| Example 7 | 52 | 2.14 | 5.12 |
| Example 8 | 45 | 2.10 | 5.10 |
| Comparative Example 1 | 20 | 1.75 | 3.56 |
| Comparative Example 2 | 19 | 1.71 | 3.55 |
| Comparative Example 3 | 22 | 1.75 | 3.56 |
| Comparative Example 4 | 22 | 1.65 | 3.52 |

| Examples and Comparative Examples | Resin-coated magnetic core particles | | |
|---|---|---|---|
| | Coating amount (wt %) | Electrical resistance (Ω · cm) | Saturation magnetization value (emu/g) |
| Example 3 | 2.7 | $8 \times 10^{13}$ | 74 |
| Example 4 | 2.0 | $7 \times 10^{13}$ | 31 |
| Example 5 | 1.7 | $4 \times 10^{12}$ | 75 |
| Example 6 | 1.2 | $8 \times 10^{10}$ | 76 |
| Example 7 | 2.5 | $7 \times 10^{12}$ | 64 |
| Example 8 | 1.5 | $5 \times 10^{13}$ | 61 |
| Comparative Example 1 | 2.0 | $7 \times 10^{9}$ | 75 |
| Comparative Example 2 | 2.3 | $3 \times 10^{12}$ | 76 |
| Comparative Example 3 | 1.8 | $7 \times 10^{9}$ | 76 |
| Comparative Example 4 | 2.1 | $3 \times 10^{9}$ | 75 |

| Examples and Comparative Examples | Resin-coated magnetic core particles Change in charge amount | | |
|---|---|---|---|
| | Initial (μC/g) | After shaking (μC/g) | Percentage of change (%) |
| Example 3 | −60 | −57 | 5 |
| Example 4 | −38 | −35 | 7 |
| Example 5 | −45 | −42 | 6 |
| Example 6 | −35 | −33 | 5 |
| Example 7 | −31 | −28 | 9 |
| Example 8 | −52 | −50 | 3 |
| Comparative Example 1 | −56 | −26 | 53 |
| Comparative Example 2 | −35 | −18 | 48 |
| Comparative | −26 | −16 | 38 |

TABLE 4-continued

| | | | |
|---|---|---|---|
| Example 3 | | | |
| Comparative Example 4 | −25 | −20 | 20 |

Upon conducting the durability test, the composite particles obtained in Comparative Example 1 which were composed of the magnetic core particles coated with the silicone resin, showed a large change in charge amount. As a result, it is considered that the segregation of the coupling agent was caused in the coating resin layer, so that the coating resin layer was peeled off when exposed to mechanical impact upon the durability test.

Incidentally, the metal alkoxides G and H, the coupling agents b to d and the organic tin compound e as shown in Table 3, represent the following compounds, respectively.

<Metal Alkoxide>

Alkoxide G: titanium-tetra-n-butoxide (n=4, M=Ti)

Alkoxide H: titanium-tetra-iso-propoxide (n=3, M=Ti)

<Coupling Agent>

Coupling agent b: N-β-(aminoethyl)-γ-aminopropylmethyl dimethoxysilane (tradename: KBM602, produced by Shin-Etsu Chemical Co., Ltd.)

Coupling agent c: N-phenyl-γ-aminopropyl trimethoxysilane (tradename: KBM573, produced by Shin-Etsu Chemical Co., Ltd.)

Coupling agent d: γ-glycidoxypropyl trimethoxysilane (tradename: KBM402, produced by Shin-Etsu Chemical Co., Ltd.)

<Organic Tin Compound>

Organic tin compound e: di-n-butyl tin dilaurate

What is claimed is:

1. Magnetic particles having an average particle size of 10 to 200 μm, comprising:

magnetic core particles; and a coating layer formed on each surface of said magnetic core particles, consisting essentially of:

(1) a silicone resin, (2) at least one metal alkoxide represented by the general formula (I):

$$(RO)_nM \quad (I)$$

wherein R is a $C_1$ to $C_{16}$ alkyl group; M is Al, Ti, Na, K, Ca, Zn or Fe; and n is an integer of 1 to 4, in an amount of 0.05 to 0.3% by weight based on the weight of said silicone resin (solid content), and (3) at least one silane coupling agent selected from the group consisting of an amino-containing silane coupling agent and an epoxy-containing silane coupling agent in an amount of 0.1 to 20.0% by weight based on the weight of said silicone resin (solid content).

2. Magnetic particles according to claim 1, wherein the amount of said coating layer is 0.05 to 10.0% by weight based on the weight of said magnetic core particles.

3. Magnetic particles according to claim 1, wherein R in the general formula (I) is a $C_2$ to $C_8$ alkyl group.

4. Magnetic particles according to claim 3, wherein R in the general formula (I) is a $C_2$ to $C_4$ alkyl group.

5. Magnetic particles according to claim 1, wherein M in the general formula (I) is Al or Ti.

6. Magnetic particles according to claim 1, wherein said magnetic core particles are granulated sintered particles or composite particles.

7. Magnetic particles according to claim 1, wherein said magnetic core particles have an average particle size of 8 to 195 μm.

8. A magnetic carrier for an electrophotographic developer, which comprises the magnetic particles set forth in claim 1.

9. A developer comprising the magnetic carrier set forth in claim 8 and a toner.

10. Magnetic particles according to claim 1, wherein the average particle size of the magnetic particles is 10 to 50 μm.

11. Magnetic particles according to claim 1, wherein the silicone resins have a ratio of trifunctional silicone to bifunctional silicone of in the range of 95:5 to 40:60.

12. Magnetic particles according to claim 1, wherein the amino-containing silane-based coupling agent is selected from the group consisting of γ-aminopropyl trimethoxysilane, N-β-aminoethyl-γ-aminopropyl trimethoxysilane, N-β-aminoethyl-γ-aminopropylmethyl dimethoxysilane and N-phenyl-γ-aminopropyl trimethoxysilane.

13. Magnetic particles according to claim 1, wherein the epoxy-containing silane-based coupling agent is selected from the group consisting of γ-glycidoxypropylmethyl diethoxysilane, μ-3,4-epoxycyclohexyl trimethoxysilane and γ-glycidoxypropyl trimethoxysilane.

14. Magnetic particles having an average particle size of 10 to 200 μm, comprising:

magnetic core particles; and a coating layer formed on each surface of said magnetic core particles, consisting essentially of:

(1) a silicone resin, (2) at least one metal alkoxide selected from the group consisting of aluminum-tri-n-butoxide, aluminum-tri-ethoxide, aluminum-tri-sec-butoxide, aluminum-tri-isopropoxide, titanium-tetra-n-butoxide, titanium-tetraethoxide and titanium-tetra-isopropoxide, in an amount of 0.05 to 0.3% by weight based on the weight of said silicone resin (solid content), and (3) at least one silane-based coupling agent selected from the group consisting of an amino-containing silane coupling agent, an epoxy-containing silane coupling agent, a mercapto-containing silane coupling agent, and a halogen-containing silane-based coupling agent, in an amount of 0.1 to 20.0% by weight based on the weight of said silicone resin (solid content).

15. Magnetic particles according to claim 14 wherein the halogen-containing silane-based coupling agent is selected from the group consisting of dimethyl dichlorosilane, methyl trichlorosilane, allyl dimethyl chlorosilane, allyl phenyl dichlorosilane, benzyl dimethyl chlorosilane, bromomethyl dimethyl chlorosilane, α-chloroethyl trichlorosilane and β-chloroethyl trichlorosilane.

16. Magnetic particles according to claim 14, wherein the mercapto-containing silane-based coupling agent is γ-mercaptopropyl trimethoxysilane.

17. Magnetic particles having an average particle size of 10 to 200 μm, comprising:

magnetic core particles; and a coating layer formed on each surface of said magnetic core particles, consisting essentially of:

(1) a silicone resin, (2) at least one metal alkoxide selected from the group consisting of aluminum-tri-n-butoxide, aluminum-tri-ethoxide, aluminum-tri-sec-butoxide, aluminum-tri-isopropoxide, titanium-tetra-n-butoxide, titanium-tetraethoxide and titanium-tetra-isopropoxide, in an amount of 0.05 to 0.3% by weight based on the weight of said silicone resin (solid content), and (3) at least one silane-based coupling agent selected from the group consisting γ-aminopropyl trimethoxysilane, N-β-aminoethyl-γ-aminopropyl trimethoxysilane, N-β-aminoethyl-γ-aminopropylmethyl dimethoxysilane, N-phenyl-γ-aminopropyl trimethoxysilane, β-glycidoxypropylmethyl diethoxysilane, β-3,4-epoxycyclohexyl trimethoxysilane, β-glycidoxypropyl trimethoxysilane, dimethyl dichlorosilane, methyl trichlorosilane, allyl dimethyl chlorosilane, allyl phenyl dichlorosilane, benzyl dimethyl chlorosilane, bromomethyl dimethyl chlorosilane, α-chloroethyl trichlorosilane, β-chloroethyl trichlorosilane, and γ-mercaptopropyl trimethoxysilane in an amount of 0.1 to 20.0% by weight based on the weight of said silicone resin (solid content).

18. A method of making magnetic particles having an average particle size of 10 to 200 μm, comprising applying a coating layer formed on each surface of magnetic core particles, said coating laver consisting essentially of:

(1) a silicone resin, (2) at least one metal alkoxide, and (3) at least one silane-based coupling agent selected from the group consisting of an amino-containing silane coupling agent, an epoxy-containing silane coupling agent, a mercapto-containing silane coupling agent, a halogen-containing silane coupling agent, in an amount of 0.1 to 20.0% by weight based on the weight of said silicone resin (solid content), wherein brittleness of the coating is avoided by using a non-tin containing metal alkoxide represented by the general formula (I):

$$(RO)_nM \quad (I)$$

wherein R is a $C_1$ to $C_{16}$ alkyl group; M is Al, Ti, Na, K, Ca, Zn or Fe; and n is an integer of 1 to 4, in an amount of 0.05 to 0.3% by weight based on the weight of said silicone resin (solid content).

* * * * *